United States Patent [19]

Hartman

[11] 4,193,229

[45] Mar. 18, 1980

[54] HANDRAIL FOR TELESCOPING SEATING SYSTEM WITH REMOVABLE RAILS

[75] Inventor: Arlin P. Hartman, Champaign, Ill.

[73] Assignee: American Seating Company, Grand Rapids, Mich.

[21] Appl. No.: 931,759

[22] Filed: Aug. 7, 1978

[51] Int. Cl.[2] ..... E04H 3/12; E04H 17/20

[52] U.S. Cl. ..... 52/9; 248/74 R; 256/67; 403/386; 403/398

[58] Field of Search ..... 52/9, 10, 183; 256/67, 256/68, 69; 403/386, 49, 398–400; 248/74 R

[56] References Cited

U.S. PATENT DOCUMENTS

| | | | |
|---|---|---|---|
| 1,631,831 | 6/1927 | Palmer-Jones | 403/97 |
| 2,126,844 | 8/1938 | Uecker et al. | 403/49 X |
| 3,141,643 | 7/1964 | Shrewsbury | 248/74 R |
| 3,233,853 | 2/1966 | Majewski | 248/74 R |
| 3,401,918 | 9/1968 | Wiese | 256/59 |
| 3,788,608 | 1/1974 | Raymond et al. | 52/9 X |
| 3,847,489 | 11/1974 | Van Riper | 403/110 |
| 3,902,817 | 9/1975 | Meir | 403/188 |
| 3,964,215 | 6/1976 | Hartman et al. | 52/9 |
| 3,995,832 | 12/1976 | Wiese | 256/59 |

FOREIGN PATENT DOCUMENTS

| | | | |
|---|---|---|---|
| 2509464 | 9/1976 | Fed. Rep. of Germany | 52/183 |
| 658685 | 3/1963 | United Kingdom | 403/400 |

*Primary Examiner*—Ernest R. Purser

*Attorney, Agent, or Firm*—Emrich, Root, O'Keeffe & Lee

[57] ABSTRACT

In a telescoping seating system, handrail support posts are mounted at the sides of the telescoping rows. Upper and lower handrail members are releasably clamped to the posts by a clamp assembly which includes a locking bolt received in an associated post, and a clamp nut received on an associated locking bolt and including means preventing rotation of the nut relative to the post. A quarter-turn motion of the bolt cams the clamp nut to securely hold the rail against the post, while a reverse quarter-turn motion of the bolt loosens the clamp nut and permits removal of the rail members only.

8 Claims, 5 Drawing Figures

Fig. 1
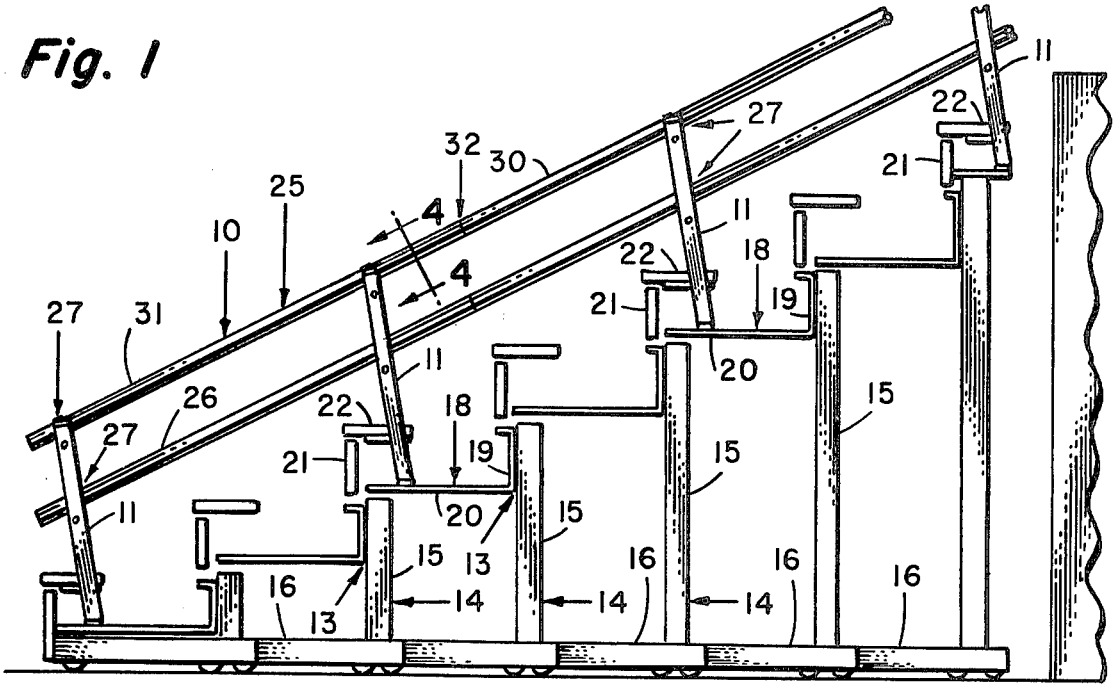
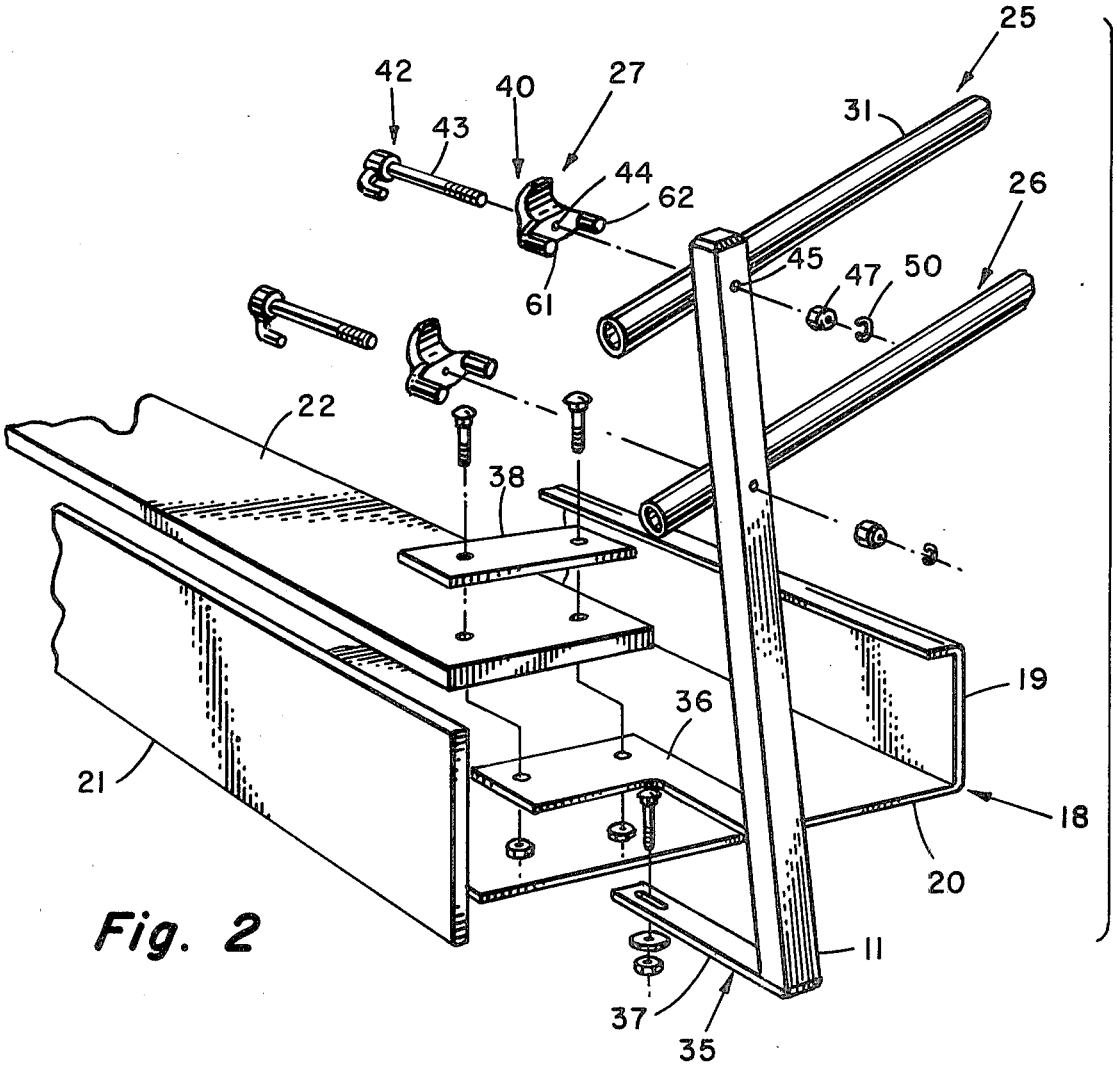
Fig. 2

HANDRAIL FOR TELESCOPING SEATING SYSTEM WITH REMOVABLE RAILS

BACKGROUND AND SUMMARY

The present invention relates to handrails for seating systems; and more particularly it relates to a handrail for use with a telescoping seating system wherein the rail members are quickly and easily installed for use or removed and placed on the deck of a row for storage.

A telescoping seating system is one in which a plurality of rows are movable individually between a closed or storage position in which all of the rows are in superimposed relation, and an extended use position in which the rows are in stepped relation. One such system is disclosed in co-owned U.S. Pat. No. 3,667,171, of McClelland and Raymond, issued June 6, 1972.

In efforts to enhance the safety of occupants of such seating systems during use, there have been many efforts to provide handrails for the systems.

Briefly, because of the need to accommodate the handrail when the rows are both in the extended and the retracted positions, early attempts to provide handrails for telescoping seating systems required removal of the handrails. Many of these early systems required so much labor for assembly and disassembly, or, in the case where the handrail was stored in a separate room, so much labor for transporting the rails, that they frequently were not used. One system designed to overcome the problem of transportation of the handrail from a different room is disclosed in co-owned U.S. Pat. No. 3,788,608, of Raymond, Lewis and Quigley, issued Jan. 29, 1974. In this system, upper and lower wooden guardrails were pivotally attached respectively to upper and lower support posts mounted to the decks of the system. For storage, a threaded fastener was unloosened for each post, the upper post removed from its mounting socket, and the rail was then folded vertically and then sideways onto a deck for storage. This system never achieved commercial acceptance.

A second type of handrail for telescoping seating systems, disclosed in U.S. Pat. No. 3,401,981, of Harold Wiese, issued Dec. 17, 1968, employed a series of interconnected telescoping tubes between upright posts, and the tubular sections of a handrail telescoped between open and closed positions with the seating rows. This system has achieved commercial acceptance, but it is somewhat expensive to manufacture.

There is a need for a handrail for telescoping seating systems which is economical, requires a minimum of hand labor for assembly, and permits the rails to be stored on the deck of a row. The present invention is directed to such a system.

Briefly, the present invention provides for a plurality of posts which are secured to the rows at a predetermined spacing. Preferably, these posts are inclined slightly forwardly. Upper and lower handrail members are mounted to the posts by a clamp assembly which includes a locking bolt rotatably received in a post and a clamp nut which defines a clamping surface conforming to the shape of the handrail member. The handrail members may themselves be formed of individual tubular elements which are coupled together by means of a swaged connection.

The clamp nut includes a pair of ears which straddle the post and prevent rotation of the clamp nut relative to the post. This maintains the nut in its upright position even when unlocked, and facilitates assembly of the rail members to the clamp nut. When the clamp assembly is in the unlocked position, the clamp nut is loose, and free to extend laterally relative to the post, to permit assembly or disassembly of the rail members. When the locking bolt is turned a quarter-turn, it forces the clamp nut to clamp the rail against the post to hold it securely to the post. The clamp assembly is tamper-proof in that occupants cannot unlock it without the use of tools.

Thus, by a simple quarter-turn of the locking bolt, each of the clamp assemblies can be unlocked, but they continue to support the handrail as the maintenance man moves from post to post. With all of the clamp assemblies unlocked, he may then remove the handrail, disassemble the swaged connection, and lay the sections on the deck for storage. All of the fastening hardware remains on the post even in the unlocked state. For assembly, these steps are followed in reverse order. The present invention thus provides an economical and safe handrail system for telescoping seating, yet one which requires a minimum of hand labor for assembly and disassembly.

Other features and advantages of the present invention will be apparent to persons skilled in the art from the following detailed description of a preferred embodiment accompanied by the attached drawing wherein identical reference numerals will refer to like parts in the various views.

THE DRAWING

FIG. 1 is a side view of a telescoping seating system including a handrail incorporating the present invention;

FIG. 2 is a fragmentary perspective view of the system of FIG. 1 showing the various parts in exploded relation;

DETAILED DESCRIPTION

Figure 3:
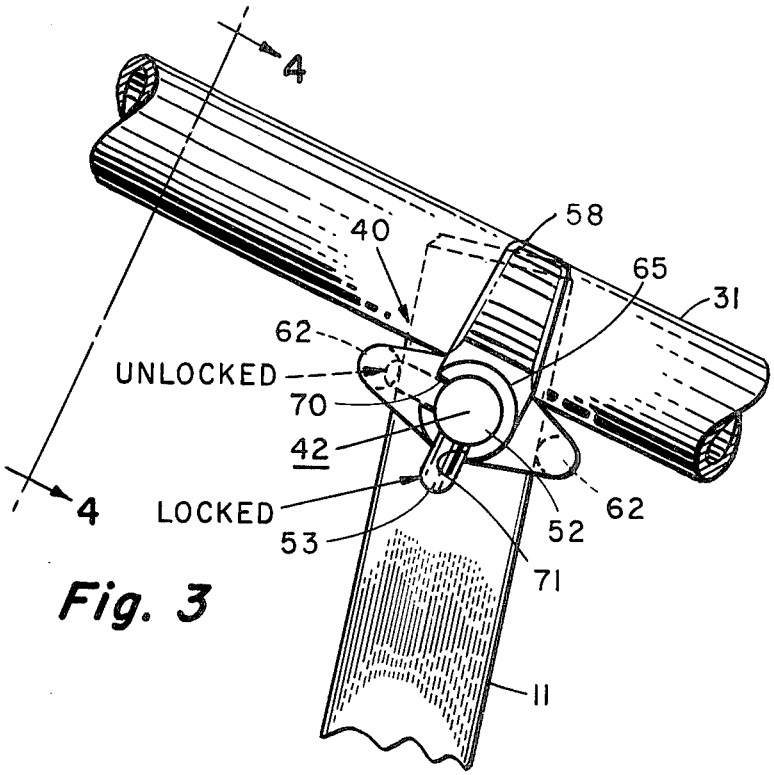
FIG. 3 is a fragmentary close-up side view of a clamping assembly for a handrail member.

Referring first to FIG. 1, reference numeral 10 generally designates a handrail assembly including four posts 11. The posts are mounted to a telescoping seating system of the type described in the above-identified U.S. Pat. No. 3,667,171.

Briefly, the telescoping seating system includes a plurality of rows, each generally designated 13, which are supported by understructures generally designated 14. The understructures include upright posts, one of which is shown for each row and designated 15. The posts 15 are mounted to movable carriages 16.

At the top of each row is a deck generally designated 18. Each deck includes a rear riser 19 mounted to the posts 15, a platform 20, a forward riser 21, and a seat board 22.

In FIG. 1, the rows 13 are shown in the extended or use position, in which the decks are in stepped or tiered relation. If the handrail members are removed from the posts 11, as will be described, the posts and rows may be telescoped to the storage position in which decks are generally vertically aligned, as is known in this art.

Turning now to the handrail system, it includes an upper handrail member 25 and a lower handrail member 26, each connected to the post 11 by clamping assembly 27. Each of the handrail members are similar, as are each of the clamping assemblies 27, so that only one need be described for a complete understanding of the invention.

The upper handrail member, then, includes an upper section 30 and a lower section 31 coupled together by a swaged fitting at 32. The lower end of the upper section 30 is swaged to a reduced diameter and is inserted into the upper open end of the lower handrail member 25.

Turning now to FIG. 2, the post 11 is a tubular member of generally square cross section, and it is mounted to the deck 18 by means of a lower bracket 35. The bracket 35 is a single piece including an L-shaped horizontal upper section 36, a vertical section welded to the inside of the post 11 (and not seen in FIG. 2) and a lower section 37. The upper section of the bracket is bolted beneath the seat board 22, and this connection is strengthened with a plate 38 on top of the seat board. The lower bracket section 37, in turn, is bolted to the platform 20. Additional details concerning the post-/deck connection may be obtained from said U.S. Pat. No. 3,964,215.

Turning now to the clamping assembly 27, it includes a clamp nut generally designated 40 and a locking bolt generally designated 42. The bolt 42 includes a threaded shank portion 43 which fits to an aperture 44 in the clamp nut 40, and through an aperture 45 in the post 11. The distal end of the shank 43 is threaded, and a lock nut 47 is received on the threaded portion.

Figure 4:
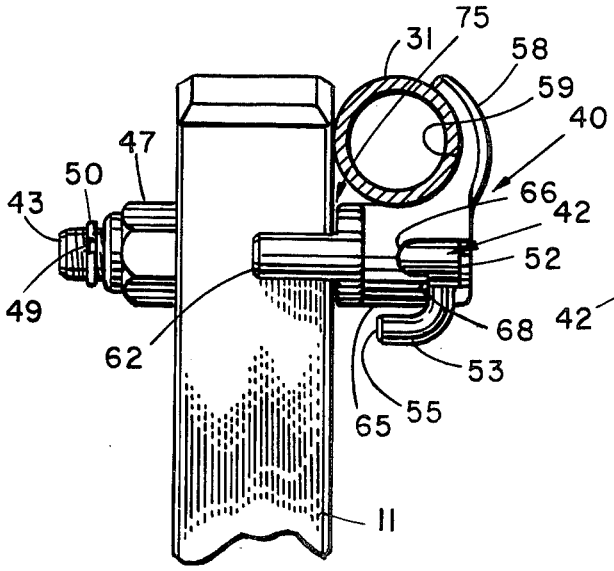
FIGS. 4 and 5 are vertical close-up front views of the clamping assembly shown in the locked and unlocked positions, respectively.

Turning now to FIG. 4, the end of the shank 43 contains a groove 49 which receives a snap ring 50 so that the nut 47 cannot be removed. The locking bolt 42 includes a head 52 in which a transverse bore is formed, and a lever member or finger 53 is inserted and welded. The finger 53 is bent inwardly at 55. The clamp nut 40 includes an upwardly extending, curved arm 58 which defines an inner surface 59 conforming to the shape of the tubular rail section 31 for clamping the rail section against the post 11, as seen, when the locking nut is in the locked position (seen in FIG. 4 and in solid line in FIG. 3).

Extending inwardly of the body of the clamp nut 40 are a pair of elongated fingers 61, 62 (see FIG. 2) which are spaced apart so as to straddle the post 11 and prevent turning of the clamp nut relative to the post. The fingers 61, 62 are long enough relative to the placement of the ring 50 on the bolt so that the clamp nut cannot turn when the bolt is in the unlocked position (see FIG. 5). Thus, the nut remains upright even when unlocked; and this facilitates assembly of the rails by a single workman.

Figure 5:
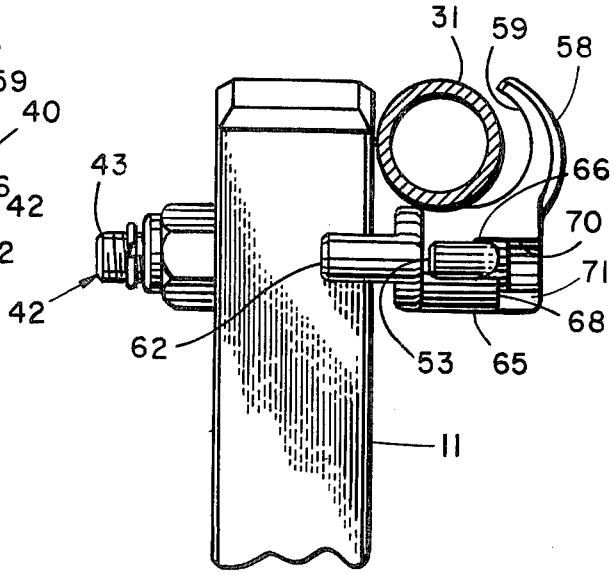

Still referring to the clamp nut, the body portion defines a cylindrical wall 65 (FIG. 3) which provides an inwardly extending recess 66 for receiving the finger 53 of the locking bolt in the unlocked or release position of FIG. 5. The cylindrical wall 65 of the clamp nut 40 also defines a cam surface 68 against which the finger 53 is firmly pressed to secure the rail in the locked position. The turning of the locking bolt 42 is limited in the unlocked position by a first stop surface 70 formed in the cylindrical side wall 65 of the clamp nut 40 and partially defining the recess 66, and in the locked position by a second stop surface 71. As seen best in FIG. 3, the stop surfaces 70, 71 are located approximately ninety degrees apart relative to the axis of the locking bolt 42, thereby limiting the motion of the locking bolt to a quarter-turn between the locked position shown in solid line, and the unlocked position shown in dashed line in FIG. 3.

OPERATION

The posts 11 are not disassembled from the decks of the individual rows when the system is retracted for storage. However, the upper and lower rail members are disassembled, and the individual sections of each rail member may be separated and stored on the decks, resting on the platform between rows. With the locking bolts in the unlocked position (that is, the finger 53 received in the recess 66) as seen in FIG. 5, the clamp nuts may be extended laterally relative to the post 11 so as to receive the rail members. Even in this extended position for receiving a rail, the clamp nuts are held upright because the ring 50 limits withdrawal of the nut and in the limit position, the fingers 62 remain straddling the post. When the rail members are all being supported by the clamp nuts and the individual rail sections are coupled together by means of the swaged connection, the nuts 47 are turned a quarter-turn so that the pin 53 engages the cam surface 68 and forces the clamp nut 40 to securely engage the rail and force it against the post in clamping relation. The nut 47 is frictionally coupled to the threads of the shank 43 of the locking bolt 42 so that the bolt turns when the nut is turned. This may be accomplished by a commercially available fiber lock nut. At the same time, this construction permits the nut 47 to be tightened onto the locking bolt to achieve the desired clamping of the rail. A slight clearance is maintained between the body of the clamp nut and the rail in the locked position, as at 75, to insure the arm 58 will tightly engage and hold the rail. The clamp nut is permitted limited rotation relative to the post, even in the locked position, to accommodate an inclination of the rail relative to the rail slightly off 90°, as seen in FIG. 3.

To disassemble the rail members for storage, the nuts 47 are turned a quarter-turn in the opposite direction so that the pin 53 engages the stop surface 70 and is aligned with the recess 66, thereby loosening the clamp nut 40.

It will be appreciated that the nut 47 is preferably located on the outside of the rail 11—that is, remote from the occupants of the seating system. This, together with the fact that it requires a tool to unlock the clamp assembly reduces the chance that an occupant would tamper with the clamp assembly.

Having thus disclosed in detail a preferred embodiment of the invention, persons skilled in the art will be able to modify certain of the structure which has been illustrated and substitute equivalent elements for those disclosed while continuing to practice the principle of the invention; and it is, therefore, intended that all such modifications and substitutions be covered as they are embraced within the spirit and scope of the appended claims.

I claim:

1. In combination with a telescoping seating system having a plurality of telescoping rows arranged in stepped relation in the use position; a handrail comprising a plurality of post mounted to the sides of respective rows and extending upwardly thereof; upper and lower elongated rail means spanning said posts in the use position; and a clamp assembly for releasably clamping each of said rail means to each of said posts, each clamp assembly comprising a locking bolt rotatably received in an associate post, a clamp nut including a clamp surface adapted to engage and hold said rail means, said clamp nut received on said bolt and movable axially thereof between a clamping position in which said clamp surface engages and secures said rail means and a release position in which said clamp surface is free from said rail means, one of said bolt and clamp nut including a cam element and the other providing a cam surface, said cam element and cam surface cooperating in limited rotary motion to cause said clamp surface to engage and hold said rail means when said bolt is turned in one direction and to release said clamp surface from said rail means to permit said rail means to be removed when said bolt is turned in the other direction.

2. The apparatus of claim 1 wherein said locking bolt includes a radially extending pin forming a lever to provide said cam element, and wherein said clamp nut defines an axially extending recess adapted to receive said pin of said locking bolt in the release position, said clamp nut further defining a cam surface adjacent said recess and extending generally transverse of the axis of said locking bolt for engaging said pin in the locked position.

3. The apparatus of claim 2 wherein said clamp nut further defines first and second stop surfaces adjacent said recess and said cam surface respectively for limiting the rotary motion of said locking bolt.

4. The apparatus of claim 3 wherein said first and second stop surfaces are displaced angularly at ninety degrees relative to the axis of said locking bolt to limit the motion of said locking bolt to a quarter-turn between the release and the clamping positions.

5. The apparatus of claim 1 or 4 wherein said clamp member further defines first and second fingers extending generally parallel to the axis of said bolt and spaced to straddle said post, said fingers being long enough to prevent rotation of said clamp nut relative to said post in the release position of said clamp nut, whereby said clamp nut remains upright in the release position to facilitate assembly of said rails thereto.

6. The apparatus of claim 1 wherein said locking bolt comprises a threaded shank and a fiber lock nut received on said shank to permit adjustment of the clamp action of said clamp nut while permitting turning of said bolt by action of a tool on said fiber lock nut.

7. The apparatus of claim 1 further comprising means on said clamp nut for engaging said post to prevent turning of said clamp nut relative to said post while permitting said clamp nut to be moved axially of said bolt to said release position.

8. The apparatus of claim 7 wherein said clamp nut includes a body portion for receiving said bolt and a curved arm defining said clamp surface, said body portion being spaced from said post to define a slight clearance in the clamping position to insure engagement between said arm and an associated rail member.

* * * * *